United States Patent [19]

Weiss

[11] 4,388,021

[45] Jun. 14, 1983

[54] METHOD OF AND DEVICE FOR MAKING CANALIZATION BY ADVANCING UNDER PRESSURE A STRING OF SEWER PIPES

[76] Inventor: Richard Weiss, Moers, Fed. Rep. of Germany

[21] Appl. No.: 296,520

[22] Filed: Aug. 26, 1981

[51] Int. Cl.[3] ..... E03F 3/06; E21D 1/00

[52] U.S. Cl. ..... 405/184; 405/133; 166/50

[58] Field of Search ..... 405/133, 138, 229, 222, 405/184, 282, 284; 166/50

[56] References Cited

U.S. PATENT DOCUMENTS

| | | | |
|---|---|---|---|
| 1,948,707 | 2/1934 | Gilman | 405/184 |
| 3,530,677 | 9/1970 | Ede | 405/133 |
| 4,322,180 | 3/1982 | Uemura et al. | 405/184 X |

*Primary Examiner*—David H. Corbin
*Assistant Examiner*—Nancy J. Pistel
*Attorney, Agent, or Firm*—Michael J. Striker

[57] ABSTRACT

A method of making canalization by pressing a string of sewer pipes in a water-conductive ground with an underground water level, is based on the formation of a water-tight working shaft or trench, then a front partition with a starting opening is erected at the side of the trench through which the string is to be advanced; then a sealed tubular cutting member is inserted into the starting opening and the sheet piling opposite the starting opening is lifted and then by an electrohydraulic pressing unit the cutting member is pressed into the soil. The cutting member is in the form of a tubular jacket having a roof-like projection at its leading edge; a cylindrical concave body is arranged in the jacket and is in contact with a thrust ring projecting radially inwardly from the jacket; the rear end portion of the jacket embraces the leading edge of the sewer pipe string and control hydraulic jacks are situated between the end face of the pipe string and the thrust ring; a mounting flange is connected to the thrust ring and supports a partition assembled of two sections which are hermetically connected to the mounting flange. The partition is provided with closeable window and with openings for the worm conveyor for removing sod from the leading part of the cutting member.

1 Claim, 7 Drawing Figures

METHOD OF AND DEVICE FOR MAKING CANALIZATION BY ADVANCING UNDER PRESSURE A STRING OF SEWER PIPES

BACKGROUND OF THE INVENTION

The present invention relates in general to sewer pipes and in particular to a method of and a device for making a canalization provided with working shafts or trenches through which a string of sewer pipes is pressed forwards in a water-conductive ground defining an underground water level.

In making canals provided with working shafts or trenches according to the pressing method in a water-conductive ground, the underground water level has hitherto been lowered to such a degree that upon working the shaft or trenches and upon the subsequent pressing of the string of sewer pipes by means of an open cutting shoe, the front ends thereof could be pressed in the ground without the application of a pressure chamber; alternatively, in the case when such a large lowering of the underground water level was not possible, the front end of the sewer pipe string immediately behind the cutting shoe was provided with a locking arrangement with a pressure chamber.

The latter arrangement however encounters considerable operational difficulties due to the fact that pressure in the pressure chamber must counteract pressure of the surrounding water in order to prevent the penetration of water into the cutting shoe. According to existing safety regulations and rules governing working conditions in pressure chambers, the crews attending the driving of the pipe underground can work only shorter shifts; moreover, the lock arrangement considerably interferes with the discharge of sod falling in the cutting shoe in the range of the pressure chamber, and altogether a considerable increase of manufacturing costs for canalization of this kind will result.

SUMMARY OF THE INVENTION

It is therefore a general object of the present invention to overcome the aforementioned disadvantages.

More particularly, it is an object of the invention to provide an improved method of and a device for laying canalization of the above-described type which is not possessed of these disadvantages.

An additional object of the invention is to provide such an improved method of and a device for making canalization by pressing forward from a working shaft or trench a string of sewer pipes which is substantially more efficient than prior-art methods.

A further object of the invention is to provide such an improved method and device which lowers manufacturing costs and improves working safety during the pipe-laying operation.

Still another object of this invention is to provide such an improved method of and a device for making canalization which does not necessitate a substantial lowering underground water levels in the surrounding ground.

In keeping with these objects and others which will become apparent hereafter, one feature of the invention resides, in a method of making canalization by advancing under pressure a string of sewer pipes in a water-conductive ground defining an underground water level, in the steps of forming at least one trench or shaft reaching to the intended floor of the canalization; making the trench water-tight by driving sheet pilings in the ground below the floor; excavating sod between the sheet pilings while feeding water in the excavation to maintain the original water level; laying a layer of concrete setting under water, on the floor; after setting of the concrete layer, removing water from the shaft or trench by pumping; forming a concrete space tub for supporting respective sewer pipes; forming a concrete partition at one side of the shaft or trench through which the sewer pipes are to be directed; the partition having a starting opening communicating with the base tub, the opening being provided with a sealing ring of a resilient material on its inner surface; lifting a portion of the sheet piling at the one side of the shaft or trench in the range of the starting opening; and thereupon installing on the base tub a tubular cutting member with a pressing unit to pass the cutting member through the starting opening and advance through the ground in the direction of the canalization.

The cutting member is constituted by a tubular steel jacket, an annular concrete body arranged for axial displacement in the jacket to cut by pressure through the ground; a thrust ring of steel engaging the rear end of the concrete body and overlapping the same radially inwardly to form an annular mounting flange; an abutment ring with a skirt formed at the rear end portion of the steel jacket to embrace the leading end portion of the sewer pipe; the abutment ring cooperating with a pressing unit acting on the thrust ring; a partition assembled of an upper section and a lower section and being sealingly secured to the mounting flange; a closeable sight window formed in the upper section; a passage formed in the lower section; and a working tool in combination with a worm conveyor extending through the passage to discharge sod loosened by the cutting member; and means arranged in the sewer pipe to discharge sod delivered by the conveyor.

The invention offers the advantage that, by virtue of water-tight structure of the working shaft or trench, as well as due to the sealing arrangement of the starting opening for driving in the string of sewer pipe, no lowering of the surrounding water level is necessary during the formation of the shaft and during the advancement of the pipe string. This feature is of importance not only for the maintenance of the underground water level in the range of such canal construction, but also is of advantage in the case when, particularly in cultivated or built-up areas, the lowering of underground water level is necessary resulting in the sinking of soil which in turn might cause damage both to structures aboveground and to structures underground. The method and device according to this invention permit, moreover, a practically fully automatic operation without the necessity for the attending working crews to be present in the area of the cutting shoe before the sealing partition that is exposed to pressure of environmental underground water. The sight window provided in the sealing partition permits an accurate observation of the front of the tunnel being worked upon by the cutting members; the monitoring of the cutting operation takes place from a relatively safe place behind the sealing partition and the worm conveyor passing through a sealed passage in the partition permits the discharge of loosened sod from the cutting member and the range of the following string of sewer pipes while the latter is subject to a continuous thrust by the pressure unit. Only in the case when the cutting shoe encounters an obstacle, might it be necessary to inspect the space before the sealing partition in the cutting shoe. In the latter case, the sightwindow in the partition is opened and, in addition, vacuum suction pipe can be applied into the space in front of the partition to temporarily lower the level of underground water in the range of the cutting shoe so that the obstacle at the front of the tunnel could be removed and the advance of the string could continue.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
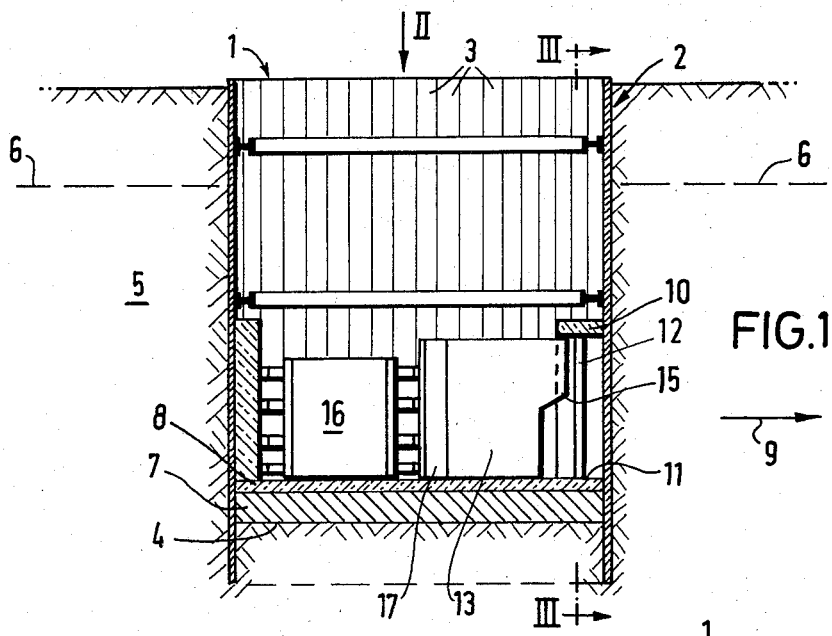
FIG. 1 is a sectional side view of a water-tight working shaft or trench illustrated with the applied cutting shoe and an electrohydraulic pressing unit for advancing a string of sewer pipes in a water-conductive ground.
Figure 2:
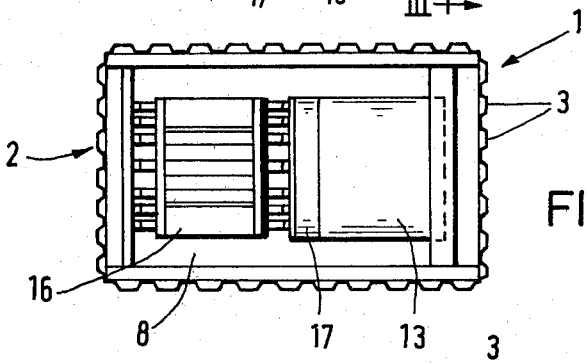
FIG. 2 is a plan view of the shaft or trench of FIG. 1 shown in the direction II.
Figure 3:
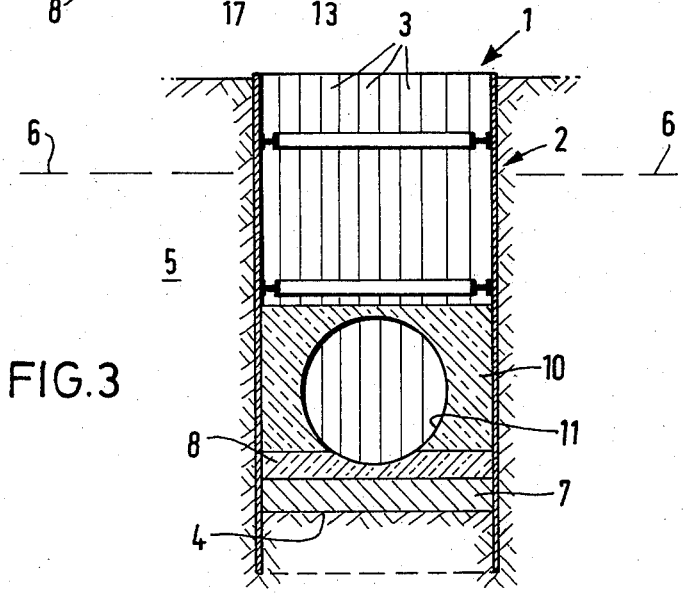
FIG. 3 is another side view of the shaft or trench of FIG. 1 taken along the line III—III.
Figure 4:
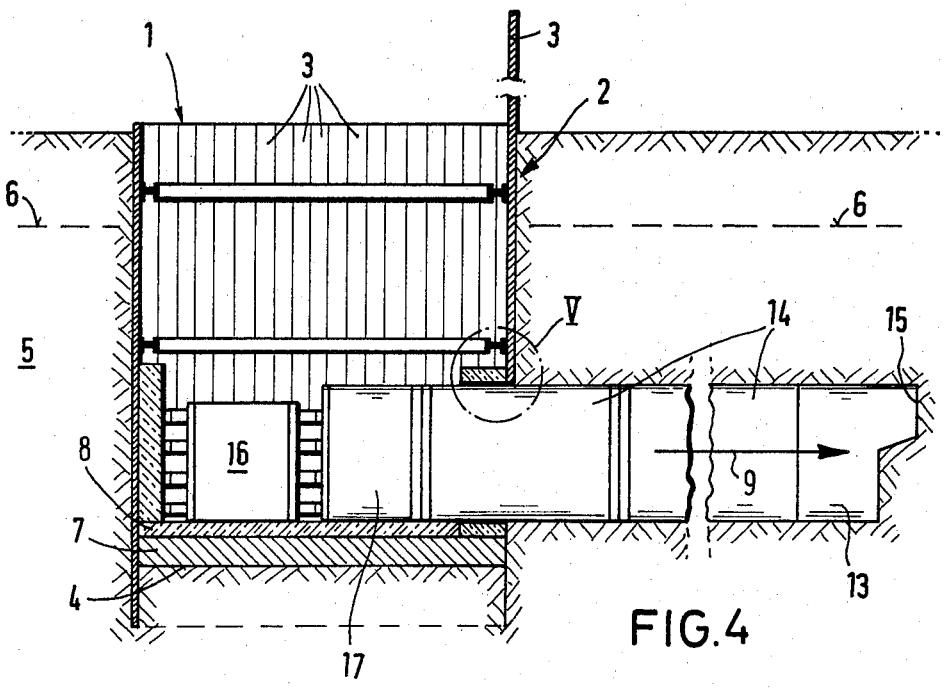
FIG. 4 is a view similar to FIG. 1 but shown in the operating condition for advancing by pressure a string of sewer pipes according to the method of this invention.

Referring firstly to FIGS. 1–4, it will be seen that preparation of the method of making canalization by pressing forward a string of sewer pipes in a water-conductive ground requires first the formation of a working shaft or trench 1. In working the shaft, water-tight side walls in the form of joint sheet piling boards 3 are first driven into the ground below the floor level 4 of the intended canalization 5. Thereupon sod layer bounded by the sheet piling above the underground water level 6 is excavated in conventional manner; the excavation of sod between water level 6 and floor 4 continues under feeding of water into the shaft 1 so that the underground water level 6 is maintained.

After the floor 4 of the shaft 1 has been reached, a concrete layer 7 of a cement setting underwater is laid on the floor, and upon setting of the layer 7 all water from the shaft is pumped out.

Figure 5:
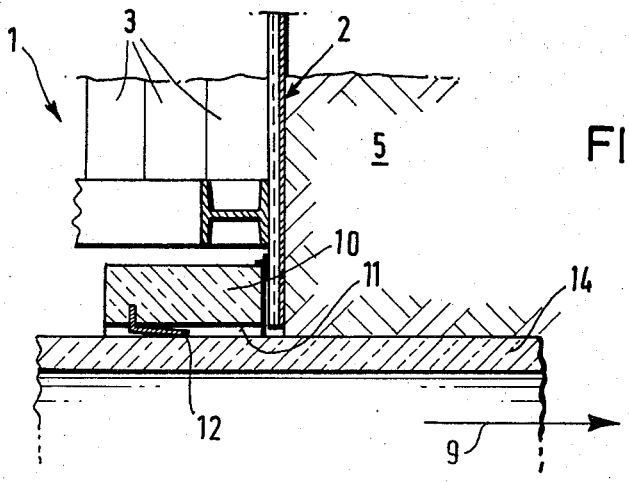
FIG. 5 is a side view of a cut away portion V of FIG. 4, shown on an enlarged scale.

As soon as the above-described steps are completed a base tub 8 of concrete is made on the layer 7 to support a string of sewer pipes which are to be advanced in the pressing direction 9 from the working shaft. Thereafter a concrete front wall 10 with a starting opening 11 is erected on the base tub 8 at the part of sheet piling 3 which is located in the direction 9 of the pipe advancement. The circular starting opening 11 is provided with a sealing collar 12 (FIG. 5) of a rubber-like elastic material which during the string pressing process first engages a cutting shoe 13 and thereupon the consecutive sewer pipes 14 of the string connected to the rear end of the cutting shoe 13. The sealing collar 12 is embedded in the front wall 10 in such a manner that its free part is bent in the direction of advance of the string 14 and is acted upon by pressure of the underground water in the area of the cutting edge and by this pressure it hermetically seals the cutting space from the interior of the shaft 1.

At the beginning of the pressing operation the cutting shoe 13 is first applied on the base tub 8 and oriented so that its forwardly projecting roof-like cutting part 15 is directed into the starting opening 11. Subsequently, the cutting shoe, by means of an electrohydraulic pressing unit 16 and by means of an interposed front piece 17, is pressed into the opening to such an extent that the edge of the projecting part 15 abuts against the sheet piling facing the starting opening 11 in the wall 2 and the tubular jacket of the cutting tool is completely surrounded by the sealing collar 12. Thereupon, sheet piling boards in the range of opening 11 are raised above the opening so that the cutting shoe with the subsequent string 14 of sewer pipes can advance into the soil without permitting the underground water to penetrate into the working shaft 1.

Figure 6:
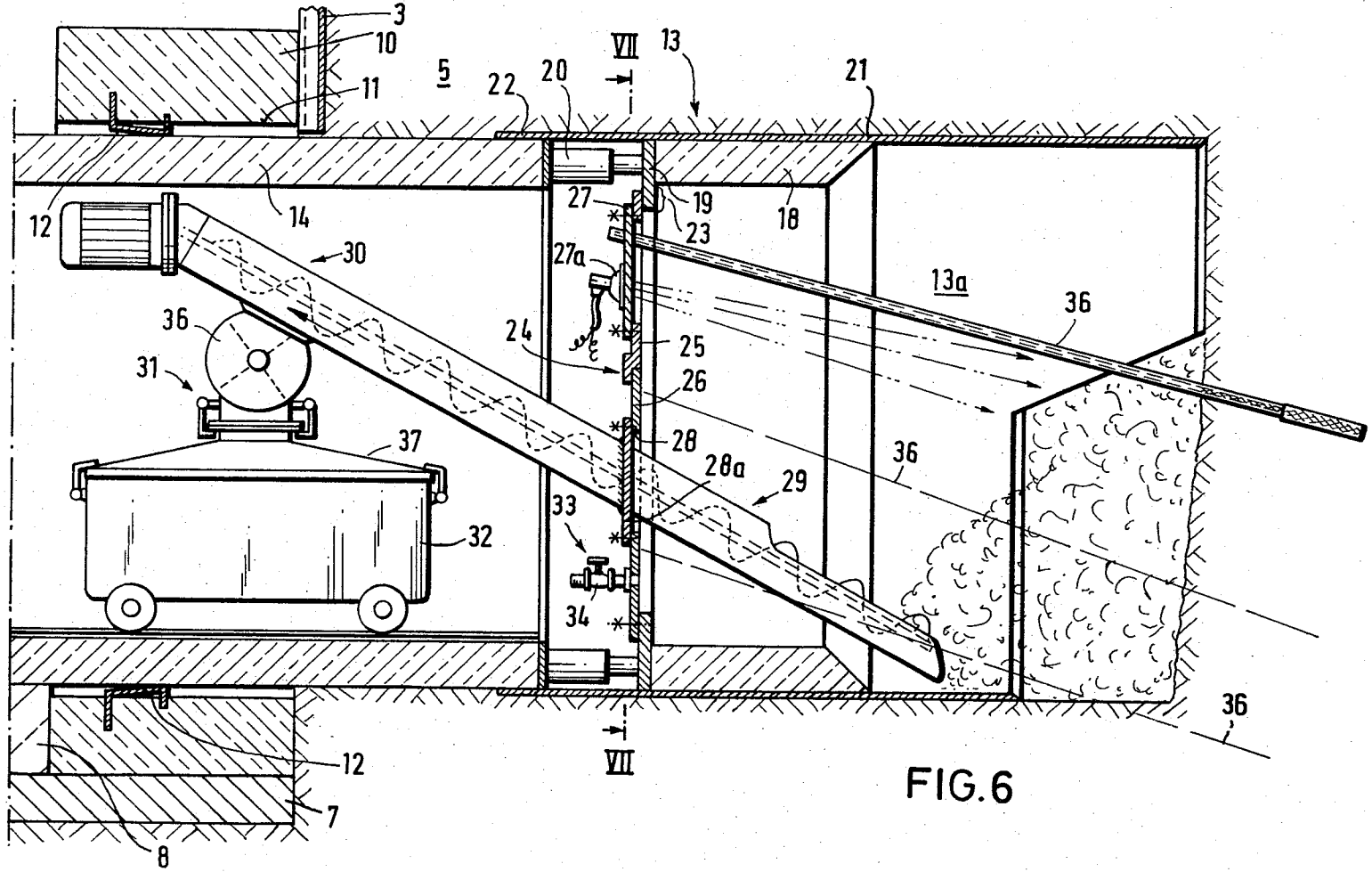
FIG. 6 is a side view shown in section on an enlarged scale of the front and of a sewer pipe string with an adjoining cutting shoe during the advancement in a water-conductive ground.
Figure 7:
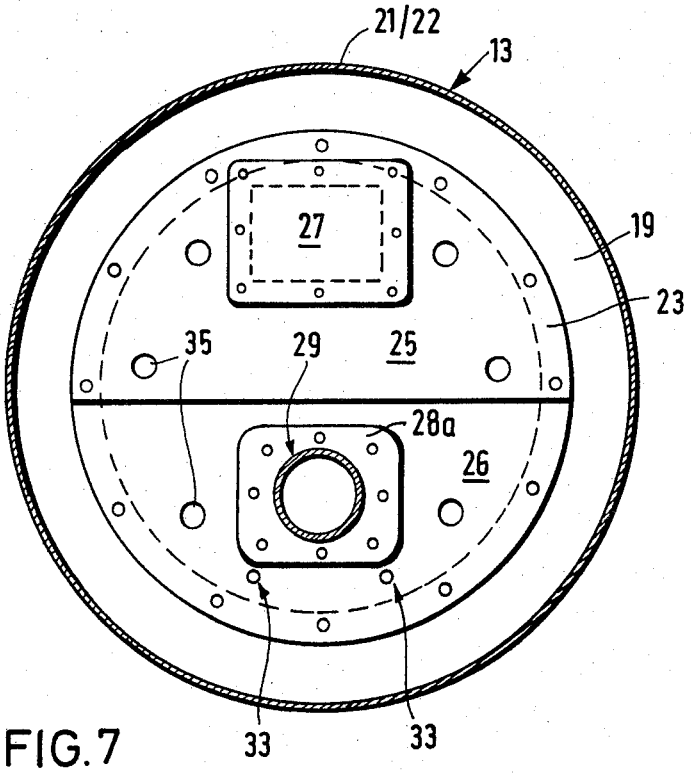
FIG. 7 is a sectional front view of the arrangement of FIG. 6 taken along the line VII—VII.

Referring now to FIGS. 6 and 7, the cutting shoe 13 is attached to the leading edge of the sewer pipe string 14, and in order to advance into the ground 5 the outer steel jacket 21 of the cutting shoe 13 is reinforced by a tubular body 18 made of concrete and having its rear end face supported on an inwardly projecting thrust ring 19 which overlaps the tubular body 18 by a mounting flange 23. The rear end part of the steel jacket 21 is in the form of a skirt 22 which surrounds the leading end portion of the sewer pipe string 14. A set of pressure jacks 20 is arranged between the end of the string 14 and the thrust ring 19 to press the entire cutting shoe 13 forwardly in a horizontal or even in an inclined direction as necessary for laying the canalization string.

The radially inwardly directed mounted flange 23, which is preferably integral with the thrust ring 19, serves for sealingly mounting a partition 24.

The partition 24 is assembled of two parts, namely of an upper segment 25 and a lower segment 26 which abut against each other along a substantially horizontal separation line. In the upper segment 25 of the partition 24 a sight window 27 with an illumination source **27*a* is provided. The sight window 27 can be opened and closed when desired. The lower segment 26 is formed with a sealed passage 28 which by means of an elastic holder 28*a* supports a working tool 29 associated with a worm conveyor which projects into the front part of the cutting shoe and is inclined upwardly from the bottom of the tunnel for the pipe string 14 up to the upper part of the subsequent pipe string behind the partition 24. The elevated discharge end 30 of the worm conveyor communicates with a transfer chute 31 which connects the worm conveyor to a conventional discharge conveyor or serves for charging respective transport carriages 32**.

Both segments 25 and 26 of the sealing partition 24 are provided near their periphery with a plurality of pressure-air connections 33 with corresponding shutoff valves 34 for feeding pressurized air into the space **13*a* in front of the partition 24; in addition, apart from the aforementioned sight window 27 and the sealed passages 28 and 28*a* for the worm conveyor, there are provided additional passages 35 with seals for passing through a plurality of vacuum-operated suction pipes 36 of which one is schematically illustrated in FIG. 6. The suction pipes 36 serve for a temporary lowering of local underground water level in the range of the space 13***a* of the cutting shoe when the latter encounters an obstacle in the ground.

The combined worm conveyor working tool 29 in the preferred embodiment of this invention is provided at its discharge end 30 with a bucket wheel charging valve 36 which in known manner communicates with the filling opening in the lid 37 of a conventional conveyor or of the transport carriage 32. The lid 37 on the carriages 32 or at the intake port of a conventional conveying device, is hingedly mounted by means of hinged straps.

It will be understood that each of the elements described above, or two or more together, may also find a useful application in other types of constructions differing from the types described above.

While the invention has been illustrated and described as embodied in connection with a string of sewer pipes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patents is set forth in the appended claims:

1. A method of making canalization by advancing under pressure a string of sewer pipes in a water-conductive ground defining an underground water level, comprising the steps of forming in the ground at least one shaft or trench having a floor by driving sheet piling excavating sod between the sheet piling; feeding water in the excavation to maintain the original water level; laying a layer of concrete setting underwater on the floor; after setting of the concrete layer, removing water from the shaft or trench; thereafter forming a concrete base tub on the layer of concrete for supporting respective sewer pipes; forming a concrete front partition at one side of the shaft or trench through which the consecutive sewer pipes are to be advanced, the partition having a starting opening communicating with the base tub, the opening being provided with a sealing ring of a resilient material on its inner surface; inserting a tubular cutting member snugly fitting the sealing ring into the opening and closing the communication between the interior of the cutting member and the shaft; then lifting a portion of the sheet piling in the range of the starting opening; and pressing consecutive sewer pipes against the rear end of the cutting tool in the direction of advancement.

* * * * *